United States Patent [19]

Blau

[11] 4,118,803

[45] Oct. 10, 1978

[54] COLLAR STAY SYSTEM

[76] Inventor: Harry Blau, 1431 Ocean Ave., Apt. 1412, Santa Monica, Calif. 90401

[21] Appl. No.: 832,113

[22] Filed: Sep. 12, 1977

[51] Int. Cl.[2] ..... A41B 3/08

[52] U.S. Cl. ..... 2/132; 2/262

[58] Field of Search ..... 2/132, 134, 256, 257, 2/262

[56] References Cited

U.S. PATENT DOCUMENTS

| | | | |
|---|---|---|---|
| 2,639,435 | 5/1953 | Less | 2/132 |
| 2,651,782 | 9/1953 | Oulouhojian | 2/132 |
| 2,659,892 | 11/1953 | Sharp et al. | 2/132 |
| 2,732,557 | 1/1956 | Statia, Sr. | 2/132 |
| 2,771,611 | 11/1956 | Wade | 2/132 |
| 2,992,434 | 7/1961 | Weeks | 2/132 |
| 3,075,202 | 1/1963 | Rubio | 2/132 |
| 3,405,407 | 10/1968 | Ruane | 2/132 |
| 3,626,516 | 12/1971 | Ruane | 2/132 |

*Primary Examiner*—Werner H. Schroeder
*Assistant Examiner*—Moshe I. Cohen
*Attorney, Agent, or Firm*—Spensley, Horn & Lubitz

[57] ABSTRACT

Improved collar stay system, including a collar stay which engages with the tip of the collar at one end and a hinge member provided on a collar of a shirt. The hinge member is arranged and configured to engage with and hold the other end of the collar stay whereby a collar of new appearance is presented.

5 Claims, 7 Drawing Figures

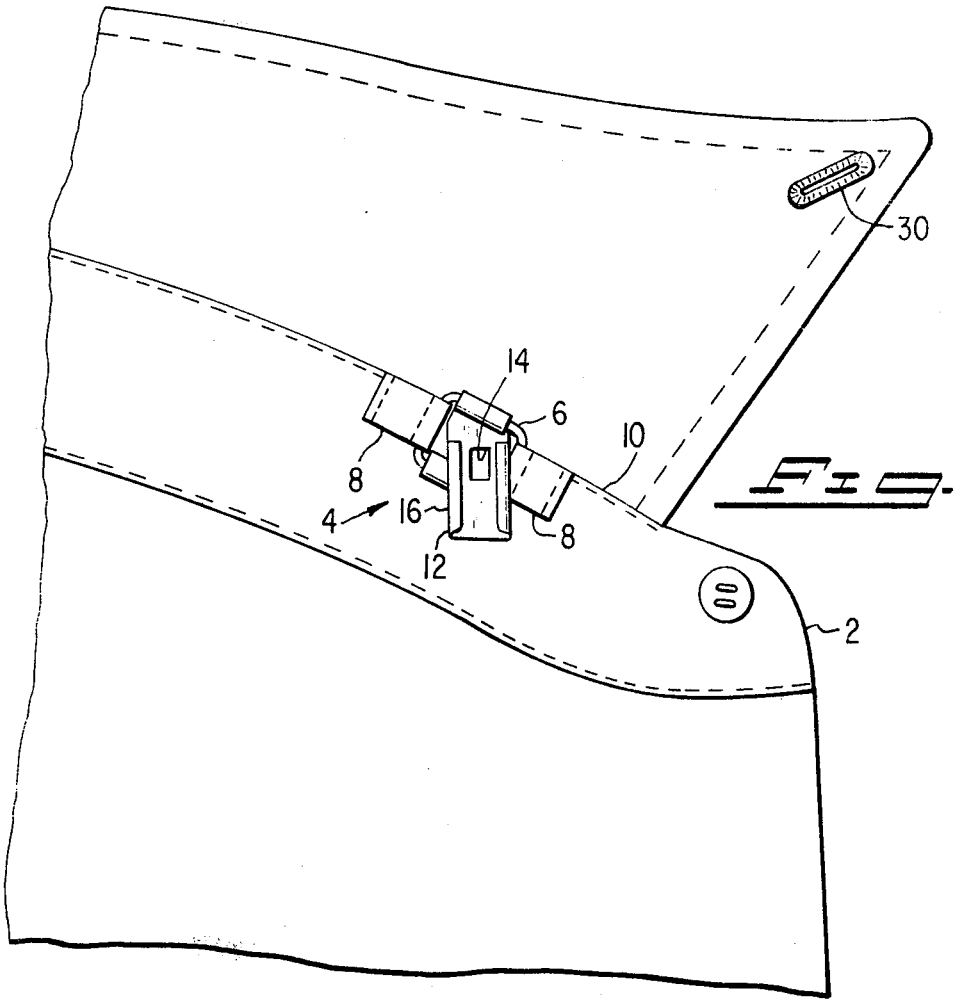
FIG. 1
FIG. 2
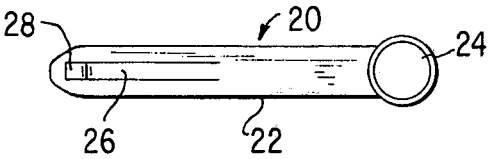
FIG. 3
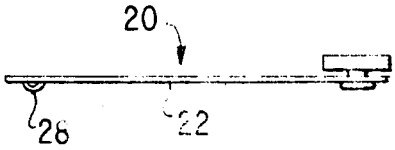
FIG. 4
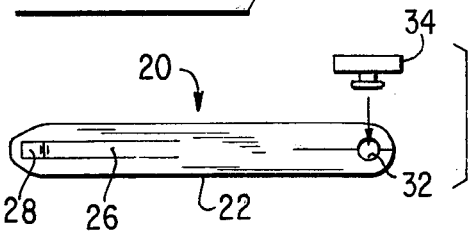

Fig. 5
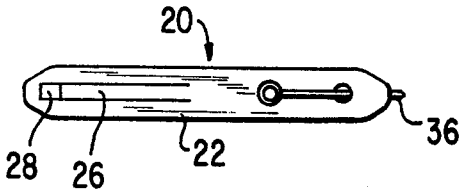
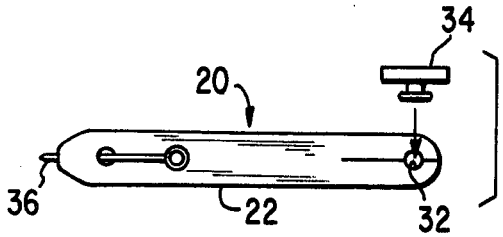
Fig. 6
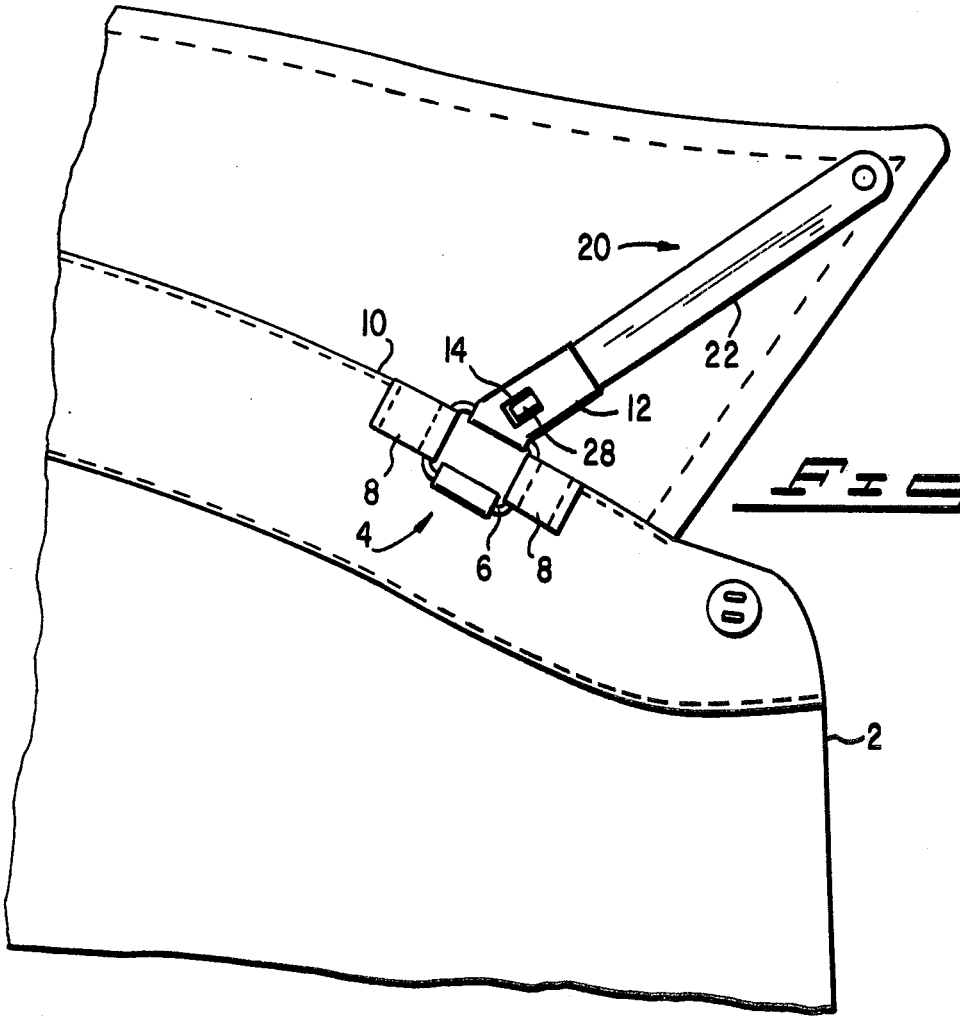
Fig. 7

COLLAR STAY SYSTEM

BACKGROUND OF THE INVENTION

1. Field of the Invention

This invention relates to shirts and more particularly to means for holding down the point of a shirt collar.

2. Prior Art

In the prior art there exists many means for holding down the collars of shirts. Such means include buttons, which are stitched to the shirt and buttonholes provided in the tip of the shirt collar, and stiff collar stays provided inside of the collar. Such methods while being functional are subject to certain disadvantges. Firstly, the button typically eventually comes off the shirt and will be required to be restiched to the shirt or in some cases will be lost completely. Furthermore, the button is not interchangeable and therefore on dress shirts wherein it is particularly desireable to wear buttons of a particular color or a particular shape to match other jewelry worn, this is a particular disadvantage. As to collar stays provided inside the collar, such collar stays are subject to damage when the shirt is washed and frequently end up bent or broken.

To overcome these problems, external collar stays have been developed. Such replaceable external collar stays while overcoming the previous difficulties, have several difficulties of their own. Such difficulties are that they are typically complex and inconvenient to use.

Accordingly, it is the general object of the present invention to provide a collar stay system which is removable from and replaceable on a shirt collar.

It is another object of the present invention to provide a collar stay system which is simple and easy to use.

It is still another object of the present invention to provide a collar stay system in which the buttons may be interchanged.

SUMMARY OF THE INVENTION

In keeping with the principles of the invention, the objects are accomplished by an improved collar stay system including a collar stay which engages with the tip of a collar and a hinge member provided on a collar of a shirt. The hinge member is arranged and configured to engage with and hold the other end of the collar stay whereby a collar of neat appearance is presented. In some of the embodiments the collar stay is provided with a means whereby the button may be interchanged while in other embodiments the collar stay is provided with a pin point so that it may be used with collars which do not use buttons.

BRIEF DESCRIPTION OF THE DRAWINGS

The above mentioned, and the features and the objects of the present invention will become more apparent by reference to the following description taken in conjunction with the accompanying drawings, wherein like-referenced numerals to like elements, and in which:

FIG. 1 is a partial view illustrating the hinge member on a shirt collar which is utilized in the collar stay system of the present invention;

FIG. 2 is one embodiment of collar stay in accordance with the teachings of the present invention;

FIG. 3 is a side plan view of the collar stay of FIG. 2;

FIG. 4 is a top view of a second embodiment of a collar stay in accordance with the teachings of the present invention;

FIG. 5 is a top view of a third embodiment of a collar stay in accordance with the teachings of the present invention;

FIG. 6 is a fourth embodiment of a collar stay in accordance with the teachings of the present invention; and FIG. 7 is a partial view of a shirt collar illustrating the complete collar stay system.

DETAILED DESCRIPTION OF THE INVENTION

Referring more particularly to the drawings, shown in FIG. 1, is a view of a portion of a shirt 2 with a part of the collar stay system in accordance with the teachings of the present invention provided thereon. The part of the collar stay system according to the teachings of the present invention comprises a hinge member 4 which comprises a rectangular ring 6 fixed to the collar and more specifically, at the neck band at first and second ends by cloth tabs 8 which are stitched to the shirt 2. The rectangular ring 6 is provided on the shirt 2 such that it lies along the breakline 10 of the collar. Rotatably coupled to the rectangular 6 is a receiving member 12. The receiving member 12 includes a locking hole 14 and curled over edges 16 for engaging with and holding a collar stay.

Referring to FIGS. 2 and 3, shown therein is a collar stay 20 in accordance with the teachings of the present invention. The collar stay 20 includes a longitudinal member 22 which has a width slightly less than the width of the receiving member 12. The longitudinal portion 22 is provided at one end with a button 24. The other end of the longitudinal member 22 is provided with a locking means 26 which consists of a thin tab with a dent locking portion 28.

In operation, as shown in FIG. 7, the collar stay 20 is inserted into the receiving member 12 of the hinge member 4 until the dent locking portion 28 engages with the locking hole 14. The button 24 is then inserted into the buttonhole 30. In this way the collar is held out stiffly and the collar may be easily rotated or folded down about its break-line 10. Therefore it would be easy to put on a tie after the collar stay system in accordance with the teachings of the present invention has been installed.

Referring to FIG. 4 shown therein is a second embodiment of the collar stay in accordance with the teachings of the present invention. Since the embodiment of FIG. 4 is substantially the same as that of FIGS. 2 and 3 except for some differences described hereinbelow, those elements which are the same their like reference numerals and a description of their interconnection and operation will be omitted.

In FIG. 4, the end of the collar stay 20 opposite the bent locking portion 28 is provided with a hole 32. In addition the hole 32 together with the end of the collar stay 20 is split. As a result of the construction of the split hole 32 in the end of the collar stay 20, a button 34 may be interchangeably provided in the end of the collar stay 20, thereby allowing one to change the color and configuration of the button to match other jewelry worn.

Referring to FIG. 5, shown therein as a third embodiment of the collar stay in accordance with the teachings of the present invention. Since FIG. 5 is similar to the collar stays of FIGS. 2, 3, and 4, except for those differences described hereinbelow, like elements are given like reference numerals and a description of their interconnection or operation is omitted.

In the embodiment of FIG. 5, instead of providing the end of the collar stay with a button, the end of the collar stay 20 is provided with a needle 36. Accordingly, the embodiment of FIG. 5 can be utilized with collars which are not provided with buttonholes 30 in the tip of the collar. In operation the collar stay of FIG. 5 is utilized by inserting the collar stay into the receiving member 12 and sticking the pin 36 into the material of the collar tip.

Referring to FIG. 6, shown therein is a fourth embodiment of a collar stay in accordance with the teachings of the present invention. The collar stay of FIG. 6 is a combination of the collar stays of FIGS. 4 and 5 and like elements are given like reference numberals.

As shown in FIG. 6 one end of the collar stay 22 is provided with a needle 36 and the other end of the collar stay is provided with a split hole 32 for inserting replacement buttons 34. Accordingly, this single collar stay can be utilized with both shirts which have a buttonhole 30 and with shirts which do not have a buttonhole 30 in the tip of the collar depending on the direction in which the collar stay 22 of FIG. 6 is inserted into the receiving member 12. In particular, if the end of the collar stay 22 with the split hole 32 is inserted into the receiving member 12, the pin 36 can be used to engage with the tip of a collar which does not have a buttonhole 30. Likewise, if the end of the collar stay 22 with the pin 36 is inserted into the receiving member 12, the button 34 provided in the split hole 32 can be used to engage with the buttonhole 30 in the tip of a shirt collar. It should be apparent to one skilled in the art that in those instances where the end of the collar stay 22 with the split hole 32 is inserted into the receiving member 12, the button 34 is first removed.

Furthermore it should be apparent to one skilled in the art that the collar stay and hinge member could be made from any stiff material such as metal, plastic, etc. Furthermore, it should be apparent that the receiving member 12 could be rotatably coupled to the collar in some other manner besides the rectangular ring 6, and that the rectangular ring 6 could be fastened to the collar by some other means besides cloth tabs 8.

In all cases, it is understood that the above described embodiments are merely illustrative of but a few of the many possible specific embodiments which represent the applications and the principles of the present invention. Numerous and varied arrangements could be readily devised by those skilled in the art without the art of spirit and scope of the invention.

What is claimed is:

1. An improved collar stay system comprising:

a collar stay which engages with a tip of a collar of a shirt at one end of said collar stay; and a hinge member formed of a rotatable ring coupled to said shirt and an elongated receiving member rotatably coupled to said ring, said receiving member having side edges configured to slidably engage and frictionally hold the other end of said collar stay.

2. A collar stay system according to claim 1 wherein said collar stay comprises a longitudinal member having a button provided on one end which engages said shirt, and a locking member at the other end of said collar stay which engages with a locking hole in said receiving member.

3. A collar stay system according to claim 2 wherein said button is detachably coupled to said collar stay.

4. A collar stay system according to claim 1 wherein said collar stay comprises a longitudinal member having a pin provided at one end which engages said shirt, and a locking member at the other end of said collar stay which engages with a locking hole in said receiving member.

5. A collar stay system according to claim 1 wherein said rectangular ring is provided on said shirt such that it is along a break line of said collar.

* * * * *